US005115589A

United States Patent [19]

Shuker

[11] Patent Number: 5,115,589

[45] Date of Patent: May 26, 1992

[54] LOCKING DEVICE FOR FIREARMS

[75] Inventor: John P. D. Shuker, Worcester, England

[73] Assignee: Gun Security Limited, Worcester, England

[21] Appl. No.: 598,711

[22] PCT Filed: Apr. 26, 1989

[86] PCT No.: PCT/GB89/00447

§ 371 Date: Oct. 23, 1990

§ 102(e) Date: Oct. 23, 1990

[87] PCT Pub. No.: WO89/10528

PCT Pub. Date: Nov. 2, 1989

[30] Foreign Application Priority Data

Apr. 27, 1988 [GB] United Kingdom ..... 8809946

[51] Int. Cl.[5] ..... F41A 17/02; F41A 17/44

[52] U.S. Cl. ..... 42/70.11

[58] Field of Search ..... 42/70.11

[56] References Cited

U.S. PATENT DOCUMENTS

| | | | |
|---|---|---|---|
| 37,946 | 3/1863 | Bonanzo | 42/70.11 |
| 2,836,918 | 6/1958 | Pula et al. | 42/70.11 |
| 2,937,666 | 5/1960 | Maisch | 42/70.11 |
| 3,104,538 | 9/1963 | Roberts et al. | 70/1.5 |
| 3,154,874 | 11/1964 | Stewart | 42/70.11 |
| 4,512,099 | 4/1985 | Mathew | 42/70.11 |
| 4,827,649 | 5/1989 | Sheehan | 42/70.11 |

FOREIGN PATENT DOCUMENTS

| | | | |
|---|---|---|---|
| 602163 | 7/1933 | Fed. Rep. of Germany | 42/70.11 |
| 1013549 | 7/1952 | France . | |
| 88/09475 | 12/1988 | World Int. Prop. O. | 42/70.11 |

*Primary Examiner*—Michael J. Carone

*Attorney, Agent, or Firm*—Oblon, Spivak, McClelland, Maier & Neustadt

[57] ABSTRACT

A device for insertion in the barrel or chamber of a firearm, e.g. a shotgun to prevent unauthorized use employs a key-operated lock (7) which is rotated to cause, through a screw-thread, axial movement of an operating member (25) with tapered surfaces which causes expansion of another component (21) having convergent surfaces, so as to engage tightly against the walls of the chamber. The key is used both to unlock the lock and to rotate the operating member. If an attempt is made to drive the device out from the barrel end there can be teeth (40) which spread apart to bite into the walls of the chamber.

10 Claims, 2 Drawing Sheets

LOCKING DEVICE FOR FIREARMS

This invention is concerned with a locking device for firearms, the device being of elongate form for axial insertion into an elongate chamber of a firearm, and comprising adjustment means located at a distal end of the device, locking means comprising opposed radially movable locking portions having respective mutually convergent inner surfaces, and operating means which is axially translatable into engagement with the said mutually convergent surfaces by the said adjustment means to move the locking portions outwards into engagement with the wall of the chamber and thereby prevent removal of the device from the chamber The term 'firearm' as used herein is intended to include shotguns, rifles and pistols for example.

Such a locking device for use with shotguns is already known from UK Patent Specification No. 2 143 623 A. However, this known device is really only suitable to prevent accidental misuse since it is relatively easy for an unauthorised person to remove the device.

Other proposals on these lines are disclosed in U.S. Pat. Nos. 2 530 560, 3 765 115, 3 768 189 and 4 266 356. Another British proposal is disclosed in U.K. Patent Specification 2 044 417, although in this case the lock is for the ejection port rather than the chamber.

Thus it is clear that there have been several proposals for putting a firearm out of action by inserting a body into the barrel or chamber. However, it is evident that, as far as is known, none of them has achieved any significant commercial success, if indeed any at all, and this is believed to be attributable mainly to the fact that, although they may act as a deterrent to a child using the gun, they are insufficiently secure in practice to deter a serious thief. Moreover in some cases they require modification of the firearm itself.

A general object of the present invention is to provide a form of locking device which provides a high degree of security against unauthorised use.

According to a first aspect, there is provided a locking device for firearms, the device being of elongate form for axial insertion into an elongate chamber of a firearm, and comprising adjustment means located at a distal end of the device, locking means comprising opposed radially movable locking portions having respective mutually convergent inner surfaces, and operating means which are axially translatable into engagement with the said mutually convergent surfaces by the said adjustment means to move the locking portions outwards into engagement with the walls of the chamber and thereby prevent removal of the device from the chamber, the adjustment means comprising a key-operated lock including a plurality of tumblers, a first threaded part, rotatable by the lock, and a second threaded part fast with or integral with the operating means, in threaded engagement with the first threaded part, arranged such that rotation of the first threaded part causes axial translation of the second threaded part and of the operating means.

The device can only be unlocked from the chamber by someone in possession of the correct key.

Preferably the mutually convergent inner surfaces of the locking portions converge towards the distal end of the device. Thus, any attempt to remove the device in the distal direction by exerting a force upon any part other than the locking means will tend to urge the operating member against the convergent surfaces, thereby further urging the locking portions into engagement with the walls of the chamber and increasing their locking action.

The locking means is preferably located intermediate the ends of the device, thereby reducing the risk of force being exerted on the locking means itself.

According to a further feature of the invention a locking device of the kind specified in the opening paragraph above is distinguished by the presence of tooth elements which are normally carried in a retracted position but which are arranged to move radially outwardly to engage the walls of the chamber upon application of force axially to the proximal end of the device.

This gives the added security, though at the cost of damage to the walls of the chamber. Although this damage would render the firearm useless to the owner, it would also render it useless to the thief.

The invention will now be exemplified in the following description to be read in conjunction with the accompanying drawings in which.

Figures 1, 2:
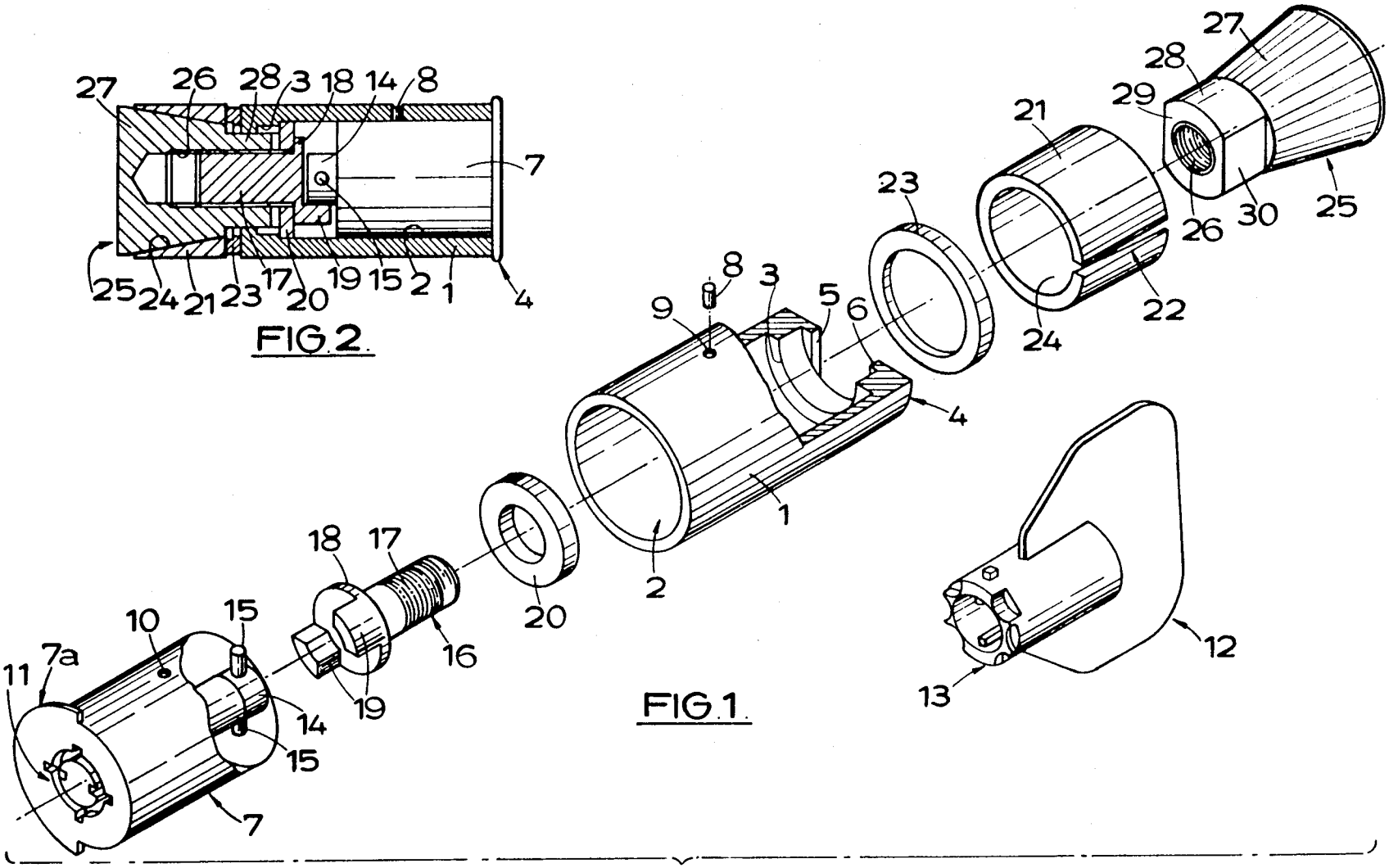
FIG. 1 is an exploded perspective view of a locking device for a shotgun in accordance with the invention.
FIG. 2 is a longitudinal section through the assembled device.

The device illustrated in FIG. 1 and 2 comprises a generally cylindrical casing 1 which is shown partially cut away in FIG. 1. The casing contains an internal bore 2 with an inward step 3 adjacent to its proximal end 4. The proximal end is also provided with a pair of opposed inwardly directed flanges 5, 6, the facing edges of which are parallel.

A proprietary cylinder lock 7 of the key-operated type, shown partially cut-away in FIG. 1, in inserted as a close fit into the opposite, distal end of the casing 1. A semi-annular flange *7a* projects outwards beyond the outer surface of the casing 1 at the distal end of the cylinder. The cylinder lock is secured in the casing 1 by a fixing pin 8 driven through an aperture 9 in the casing into a corresponding fixing hole 10 in the cylinder 7. The cylinder lock has a key hole 11 at its distal end and contains a plurality of tumblers (not shown). A key 12 having the correctly configured end 13 can be inserted into the keyhole to move the tumblers to an unlocked position in which the key can then be turned to rotate a spigot 14 which projects axially from the proximal end of the cylinder 7. Two diametrically opposed pins 15 project radially from the spigot 14 for engagement with a rotatable shaft member 16.

The shaft member 16 comprises an externally screw-threaded portion 17 at its proximal end, and a head portion 18 having two spaced distally projecting lugs 19 for engagement with the pins 15. A washer 20 is located about the shaft member 16 between the head portion 18 and the step 3.

A cylindrical locking collar 21 containing a single axial split 22 is located at the proximal end of the casing 1. The outer diameter of the collar 21 is substantially the same as that of the casing 1, from which it is separated by a thrust washer 23. As best shown in FIG. 2, the internal surface 24 of the collar 21 is of frusto-conical configuration, converging towards the distal end of the device. The collar 21 and thrust washer 23 are supported by an operating member 25 which has an internally threaded bore 26 at its distal end to receive the threaded portion 17 of shaft member 16. The proximal end portion 27 of the operating member 25 forms a head of frusto-conical shape, the taper of which matches that of the internal surface of collar 21 with which it is engaged. The distal end portion 28 of the operating member is generally cylindrical and has opposed flats 29, 30 enabling it to be non-rotatably received between flanges 5, 6 of the casing 1.

It will be observed in FIG. 2 that the proximal end of the operating member 25 projects a short distance beyond the collar 21.

In use, the device is slid axially into the cartridge chamber of a shotgun until the flange *7a* abuts the outer end of the chamber. The key 12 is inserted into the keyhole 11 and used to rotate the spigot 14 which in turn rotates the shaft member 16 via pins 15 and lugs 19. The threaded portion 17 is thus screwed into the operating member 25 which is thus translated in a distal direction. In so doing the wedging action of the tapered head 27 within the collar 21 causes the collar to radially expand into frictional engagement with the walls of the shotgun chamber, thereby locking the device firmly in place. Any attempt to remove the device by pulling from the distal end or pushing against the operating member 25 from the proximal end tends to increase the wedging effect of the head 27 in the collar 21. The device can only be released by inserting the correct key into the keyhole 11 and rotating the shaft member 16 in the opposite direction.

In order to reduce the possibility of the device being dislodged by inserting a steel rod or similar article down the gun barrel and imparting sharp hammer blows to the device, the proximal end of the operating member 25 could be provided with a covering of resilient or malleable material such as rubber or lead to absorb the blows. Also, the flange *7a* could be omitted to prevent the device from being gripped by it when fitted into the chamber. It could also be completely annular, but one half is omitted in the illustrated embodiment to clear the ejector mechanism of the shotgun. Should an attempt be made to screw the device out of the chamber the flange may reduce this risk by abutment with the ejector mechanism.

The operating member could be provided with an extension which protrudes from the gun barrel so as to indicate that the gun is fitted with the device and/or display a warning notice. The extension may be rigid or it may be flexible so that it can be coiled up when the device is removed from the gun for easy and convenient storage. An extension firmly fixed to the device may also hinder attempts to drive the device out of the chamber from the barrel.

The device could be in two parts, the operating member, collar and shaft member comprising one part which could be fixed in the barrel by a torque transmission device such as an Allen key engagable with the head of the shaft member to permit a high torque to be exerted on the locking collar. The second part may comprise the security lock with the lugs 19 being notched to engage with the pins 15 thereby precluding access to the first part by the torque transmission device.

The device shown in FIGS. 3 and 4 has a considerable amount in common with that of FIGS. 1 and 2 but some additional features, to be described later. The same reference numerals are used where appropriate. As in the earlier embodiment there is a cylindrical casing 1 which has an internal bore 2 with an internal step or shoulder 3 adjacent to its proximal end. A proprietary cylinder lock 7 of the key-operated type is inserted into the distal end of the casing and secured by a pin 8. The lock has a keyhole 11 at its distal end and contains a plurality of tumblers (not shown) so that a key of the correct configuration can be inserted into the keyhole to rotate a spigot 14 which projects axially from the proximal end of the lock. Two diametrically opposed pins 15 project radially from the spigot 14 for engagement with a rotatable shaft member 16. A resilient plug 31 is inserted into the distal end of the lock 7 to prevent damage thereto should the firing pin of a gun be operated with the device fitted.

The shaft member 16 has an externally screw-threaded axial portion 17 at its proximal end which is received within an internally threaded bore 26 of an operating member 25. This operating member is non-rotatably keyed into the proximal end of the casing 1 and includes a head portion 27 of frusto-conical shape converging towards the distal end of the device and which is located outside the casing. A cylindrical locking collar 21 containing a single axial split is located about the head of the operating member. The outer diameter of the collar is slightly less than that of the casing 1, but its internal surface is of frusto-conical shape to engage the head of the operating member 25.

The head 25 carries a proximally projecting axial spigot 32 surrounded by a radially spaced sleeve 33. The sleeve has opposed slots 34 which are radially aligned with opposed flats 35 on the spigot 32. A plunger 36 is located proximally of the operating member 25 and this comprises a cylindrical portion 37 and a distally projecting tubular spigot 38. This spigot 38 has diametrically opposed apertures 39 to receive a pair of tooth elements 40 and is a sliding fit over the spigot 32 of the operating member. The tooth elements are of round section but their outer ends 41 are chamfered to a point and their inner ends 42 are radius to a hemispherical shape. In the normal position the teeth 40 are outwardly inclined in a distal direction so that they lie in retracted positions within the slots 34. A spring locking washer 43 is located about tubular spigot 38 against portion 37 in tight engagement with the inner surface of sleeve 33 so that the plunger is restrained from moving further into the sleeve. A thin cover 44 is slid over the plunger with it proximal end in tight engagement with the portion 37 to cover the tooth elements 40 and retain them in the retracted position shown in FIG. 3.

Figure 3:
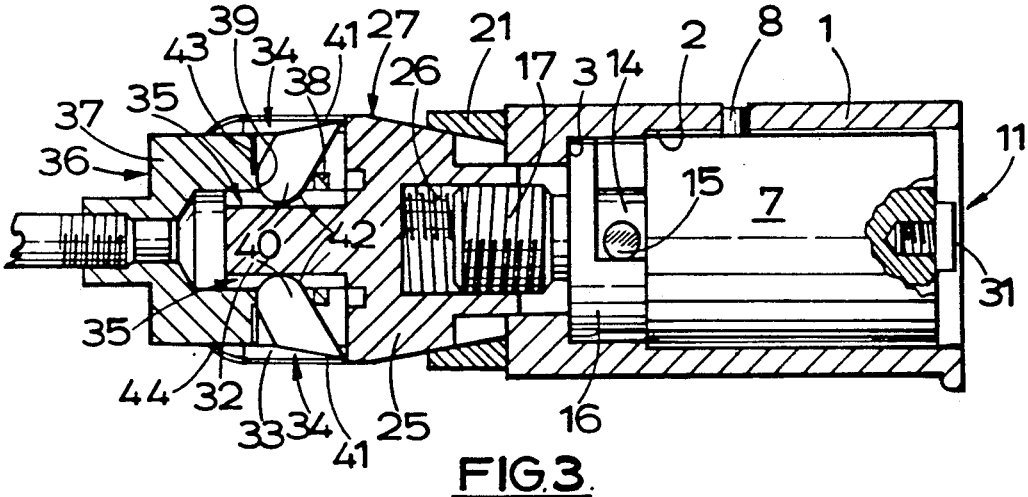
FIG. 3 is a longitudinal section through a modified locking device for a shotgun in accordance with the invention in its normal state.
Figure 4:
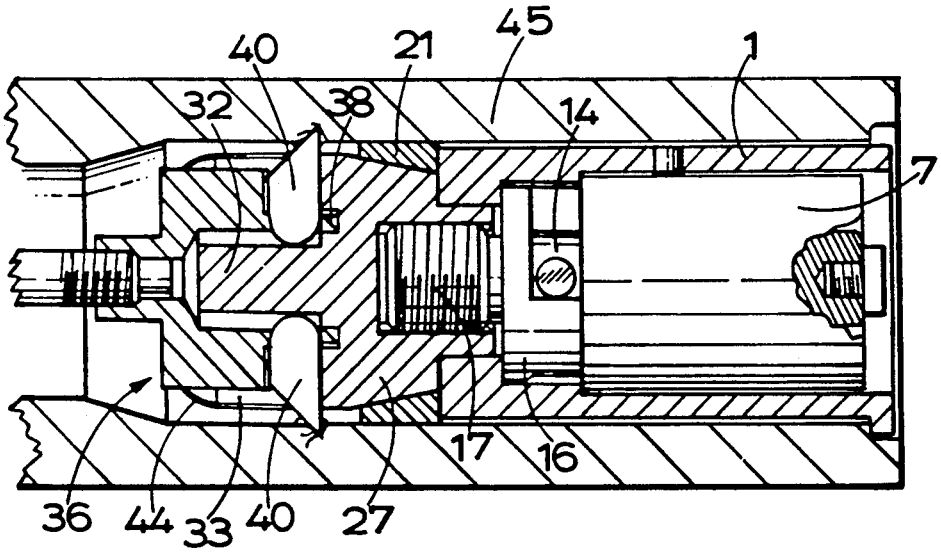
FIG. 4 is similar view of the device of FIG. 3 installed in the chamber of a shotgun after an attempt has been made to remove it by force.

In use, the device of FIGS. 3 and 4 is inserted into the cartridge chamber 45 (FIG. 4) of a shotgun and the key is inserted into the lock 7 to rotate the spigot 14 which in turn rotates the shaft member 16. The threaded portion 17 is thus screwed into operating member 25 which is thus translated in a distal direction. In so doing the wedging action of the tapered head within the collar 21 causes the collar to radially expand into frictional engagement with the walls of the shotgun chamber, thereby locking the device firmly in place. The plunger 36 will travel with the operating member 25 so that the tooth elements remain in their retracted positions. However, should an attempt be made to forcibly remove the device from the gun by administering hammer blows to the proximal end of the device, the plunger will urge the spring locking washer distally within the sleeve 33 so that the tubular spigot 37 moves over the spigot 32 which in turn urges the tooth elements 40 to move towards a radial position as shown in FIG. 4. The sharp outer ends of the elements thus move outwardly to bite into the wall of the cartridge chamber and thereby prevent removal of the device rendering the gun useless.

If the device has not been tampered with the tooth elements will of course remain in the retracted position and the device can be removed using the key to move the operating members forwardly and release the frictional coupling between the collar 21 and the wall of the chamber. As in the first embodiment the plunger may be secured to a flexible extension carrying a flag member which protrudes from the gun barrel so as to indicate that the gun is fitted with the device and/or display a warning notice.

The second embodiment will, it is true, damage the chamber of the gun if an attempt is made to drive it out from the muzzle end. This is deliberate and ensures that the gun is rendered useless to a thief who takes it and then tries to apply such steps. The device is thus effective in immobilising a firearm in a neat and simple way without the need to lock the gun away as a whole in a cabinet.

I claim:

1. A locking device for firearms, the device being of elongate form for axial insertion into an elongate chamber of a firearm, and comprising adjustment means, locking means comprising opposed radially movable locking portions having respective mutually convergent inner surfaces, and operating means which is axially translatable into engagement with the said mutually convergent surfaces by the said adjustment means to forcibly urge the locking portions outwards into engagement with the walls of the chamber and whereby frictionally prevent removal of the device from the chamber, the adjustment means comprising a key-operated lock including a plurality of tumblers, a first threaded part rotatable by the lock, and a second threaded part fast with or integral with the operating means and in threaded engagement with the first threaded part, said first threaded part being held fast against axial translation towards said locking means whereby rotation of the first threaded part in a locking direction causes axial translation of the second threaded part and the operating means towards the first threaded part to force the locking portions outwards.

2. A locking device according to claim 1 in which the first threaded part is an externally threaded shaft and the second threaded part is an internally threaded hole in the operating means.

3. A locking device according to claim 1 in which the mutually convergent surfaces of the locking portions converge towards a distal end of the device.

4. A locking device according to claim 1 in which the key-operated lock is mounted axially in a distal end of the device and is arranged to be rotatable by use of the key to act on the operating means, the rotation being converted into axial movement of the operating means by the action of co-operating screw threads.

5. A locking device for firearms, for device being of elongate form for axial insertion into an elongate chamber of a firearm, and comprising adjustment means, locking means comprising opposed radially movable locking portions having respective mutually convergent inner surfaces, and operating means which is axially translatable into engagement with the said mutually convergent surfaces by the said adjustment means to forcibly urge the locking portions outwards into engagement with the walls of the chamber and thereby frictionally prevent removal of the device from the chamber, the adjustment means comprising a key-operated lock including a plurality of tumblers, a first threaded part rotatable by rotation of a key inserted into the lock, the first threaded part and the lock being so coupled operatively as to allow a key in the lock to be rotated through a substantial distance without moving the first threaded part, and a second threaded part fast with or integral with the operating means and in threaded engagement with the first threaded part, said first threaded part being held fast against axial translation towards said locking means whereby rotation of the first threaded part in a locking direction causes axial translation of the second threaded part and the operating means towards the first threaded part to force the locking portions outwards.

6. A locking device according to either claim 1 or claim 5 comprising a tubular casing accommodating said key-operated lock and an end portion of said first threaded part operatively coupled to said lock, said end portion being held fast relative to said casing against axial translation towards said locking means, and said first threaded part projecting axially from said casing into engagement with said second threaded part.

7. A locking device for firearms, the device being of elongate form for axial insertion into an elongate chamber of a firearm, and comprising adjustment means, locking means comprising opposed radially movable locking portions having respective mutually convergent inner surfaces, and operating means which is axially translatable into engagement with the said mutually convergent surfaces by the said adjustment means to forcibly urge the locking portions outwards into engagement with the walls of the chamber and thereby frictionally prevent removal of the device from the chamber, the adjustment means comprising a key-operated lock including a plurality of tumblers, a first threaded part rotatable by rotation of a key inserted into the lock, the first threaded part and the lock being so coupled operatively as to allow a key in the lock to be rotated through a substantial distance without moving the first threaded part, and a second threaded part fast with or integral with the operating means and in threaded engagement with the first threaded part whereby rotation of the first threaded part in a locking direction causes axial translation of the second threaded part and the operating means.

8. A locking device according to either claim 7 or claim 5 in which spaced pins projecting from a rotatable spigot of the lock are arranged to engage rotationally spaced lugs projecting from said first threaded part.

9. A locking device for firearms, the device being of elongate form for axial insertion into an elongate chamber of a firearm and having a proximal end and a distal end, the device comprising adjustment means located at the distal end of the device; locking means comprising opposed radially movable locking portions having respective mutually convergent inner surfaces; operating means which is axially translatable into engagement with the said mutually convergent surfaces by the said adjustment means to move the locking portions outwards into engagement with the walls of the chamber and thereby prevent removal of the device from the chamber; tooth elements carried in the device in a normally retracted position and arranged to move radially outwards to engage the walls of the chamber upon application of force axially to the proximal end of the device, wherein the adjustment means comprises a key-operated lock including a plurality of tumblers. a first threaded part rotatable by the lock. and a second threaded part fast with or integral with the operating means and in threaded engagement with the first threaded part, whereby rotation of the first threaded part in a locking direction causes axial translation of the second threaded part and of the operating means.

10. A locking device according to claim 5 in which there are two of the said tooth elements. diametrically opposed and received in slots in a head portion or the device, the teeth occupying inclined positions with inner ends engaged by an axially movable proximal component of the device such that axial displacement of that component by force towards the distal end causes the teeth to pivot in directions such that their outer ends more outwards into engagement with the walls of the chamber.

* * * * *